US009692153B1

(12) United States Patent
Rodriguez et al.

(10) Patent No.: US 9,692,153 B1
(45) Date of Patent: Jun. 27, 2017

(54) CONNECTION SYSTEM HAVING A U-SHAPED HANDLE WITH LEGS SLIDABLY OR ROTATABLY ATTACHED TO A CAM LEVER

(71) Applicant: Delphi Technologies, Inc., Troy, MI (US)

(72) Inventors: Erick A. Rodriguez, Chihuahua (MX); Michael F. Loew, El Paso, TX (US)

(73) Assignee: DELPHI TECHNOLOGIES, INC., Troy, MI (US)

( * ) Notice: Subject to any disclaimer, the term of this patent is extended or adjusted under 35 U.S.C. 154(b) by 0 days.

(21) Appl. No.: 15/227,642

(22) Filed: Aug. 3, 2016

(51) Int. Cl.
*H01R 13/62* (2006.01)
*H01R 9/24* (2006.01)
*H01R 13/629* (2006.01)

(52) U.S. Cl.
CPC ..... *H01R 9/2425* (2013.01); *H01R 9/2458* (2013.01); *H01R 13/62938* (2013.01); *H01R 13/62955* (2013.01); *H01R 13/62966* (2013.01)

(58) Field of Classification Search
CPC ..... H01R 13/62; H01R 13/62938; H01R 13/62955; H01R 13/62966
USPC ..... 439/155, 157
See application file for complete search history.

(56) References Cited

U.S. PATENT DOCUMENTS

| | | | | | |
|---|---|---|---|---|---|
| 5,575,671 | A * | 11/1996 | Katsuma | H01R 13/62955 | 439/157 |
| 5,681,175 | A * | 10/1997 | Busse | H01R 13/62977 | 439/157 |
| 6,213,795 | B1 * | 4/2001 | Drescher | H01R 13/62977 | 439/152 |
| 6,254,414 | B1 * | 7/2001 | Sawayanagi | H01R 13/62922 | 439/310 |
| 6,733,313 | B2 * | 5/2004 | Shinozaki | H01R 13/62955 | 439/157 |
| 6,793,522 | B2 * | 9/2004 | Yamashita | H01R 13/62938 | 439/157 |
| 7,066,763 | B1 * | 6/2006 | Corwin | H01R 13/62966 | 439/157 |
| 7,094,081 | B1 | 8/2006 | Senk et al. | | |
| 7,559,778 | B2 | 7/2009 | Pittenger et al. | | |
| 7,862,353 | B1 * | 1/2011 | Azad | H01R 13/62938 | 439/157 |
| 9,306,330 | B2 * | 4/2016 | Kuroda | H01R 13/62938 | |
| 2003/0190836 | A1 * | 10/2003 | Yamashita | H01R 13/62938 | 439/489 |
| 2014/0370733 | A1 * | 12/2014 | Hashimoto | H01R 13/62938 | 439/157 |

* cited by examiner

*Primary Examiner* — Chandrika Prasad
(74) *Attorney, Agent, or Firm* — Robert J. Myers

(57) ABSTRACT

A connector system is described herein. The connector system includes cam lever devices to assist the mating of the connector bodies of the connector system to one another. The handles of the cam lever devices are movable from an extended position that provides increased leverage to a retracted position that can be used to stow the handles after the connector bodies of the connector system have been successfully mated. A method of assembling such a connector system is also described herein.

16 Claims, 15 Drawing Sheets

16
18
22
20

18
22
26
24
32

22
28
24
26
32

24
26
28
32
22

CONNECTION SYSTEM HAVING A U-SHAPED HANDLE WITH LEGS SLIDABLY OR ROTATABLY ATTACHED TO A CAM LEVER

TECHNICAL FIELD OF THE INVENTION

The present invention relates generally to connector systems and, more particularly, to a connector system including an extendable and retractable closing assist lever.

BACKGROUND OF THE INVENTION

Connection system, such as a simple electrical connector or a multi-functional electrical distribution center, are widely used. The electrical distribution centers are generally a central junction box or block system designed as a stand-alone assembly. The electrical connectors typically electrically connect at least two wire harnesses together and thus house a plurality of mated male and female terminals. The distribution centers perform a similar function as the electrical connectors, but may also house various fuses, relays and other electrical devices in a central location. Electrical distribution centers not only reduce cost by consolidating various functions and/or electrical connections into one block, but the centers also reduce the number of cut and spliced leads which increases reliability. Such electrical distribution centers include provisions for electrically connecting a power source and electrical devices housed in the junction block to electrical wiring harness connectors for supplying power and control signals to various electrical systems.

In many electrical distribution center applications, such as that used in the engine compartment of a vehicle, disclosed in U.S. Pat. No. 5,715,135, to Brussalis, hereby incorporated by reference, devices such as fuses and relays of the electrical distribution centers are accessible from the top with mating connectors protruding from a bottom side. Unfortunately, due to this orientation, access to the connectors is often difficult for mating and unmating. In many cases, the electrical distribution center has to be flipped upside down, the connectors assembled, and the entire assembly with protruding wire harnesses flipped again into a final position.

Known electrical distribution centers such as that described in the Brussalis reference, typically mount the fuses, relays and electrical devices to a top side of an upper electrical distribution panel. A plurality of double ended terminals are engaged to and extend through a tray located below the panel. A top end of each terminal projects through a respective slot of the upper panel for engagement to the fuse, relay or electrical device. A bottom end of the male terminal projects downward through respective slots of yet a second lower tray for electrical engagement to terminals locked into at least one electrical connector body which is engaged to a lower support structure of the distribution center. Unfortunately, the panel, trays and connector bodies are all held together by a plurality of threaded fasteners which is costly to manufacture and requires special tools for assembly and maintenance purposes.

Known improvements to this conventional distribution center are described in U.S. Pat. No. 7,094,081 B1, to Senk, issued Aug. 22, 2006. According to Senk, the distribution assembly is not flipped when assembling internal connectors and does not require the use of threaded fasteners or bolts thus does not need special assembly tools to secure various housings of the distribution assembly together. Instead, an engagement mechanism or leverage device having two independent cam levers applies a normal force when the cam levers are rotated to mate the distribution assembly.

The length of cam levers directly impacts engagement forces needed to be applied by an assembly operator to the cam levers in order to secure the various housings of the distribution assembly together. The length of the cam levers is subject to the space available in the vehicle to package the distribution center. When packaging space in the vehicle does not allow long cam levers and as such are shortened which in turn increases operator engagement forces. Therefore a connector system that has cam levers sufficiently long to provide a low engagement force while being able to be accommodated in tight packaging spaces remains desired.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with an embodiment of the invention, a connector system is provided. The connector system includes a first connector body in which a first terminal is disposed and a second connector body in which a second terminal configure to mate with the first terminal is disposed. The second connector body is constructed and arranged to mate with the first connector body along a mating axis. A first and second cam stud each projects from opposing sides of the first connector body. A first and second cam lever are attached to opposite sides of the second connector body and are each rotatable about a first rotation axis that is orthogonal to the mating axis. The first and second cam levers each have a cam track that is configured to slidingly engage the first and second cam studs respectively. A generally U-shaped first lever handle has legs that are slideably attached to both the first and second cam levers and a cross bar that interconnects the legs. Each of the leg defines a slot. The first and second cam levers each include a flexible beam that has a locking projection extending from the beam. The first lever handle is secured in an extended position when the locking projection is engaged within the slot and wherein the first lever handle is slideable to a retracted position when the locking projection is disengaged from the slot.

The first connector body may include a first and second tab each projecting parallel to the mating axis from opposing sides of the first connector body. The first and second tabs are configured to flex the flexible beams as the first and second cam levers are moved from an open to a mated position, thereby disengaging the locking projections from the slots. Each leg of the first lever handle may include a strap spanning each slot. The first and second tabs are disposed intermediate the straps and the flexible beams when the first and second cam levers are in the mated position.

The connector system may further include a third and fourth cam stud, each projecting from opposing sides of the first connector body and a third and fourth cam lever, each attached to opposite sides of the second connector body and rotatable about a second rotation axis that is orthogonal to the mating axis. The third and fourth cam levers each have a cam track configured to slidingly engage the third and fourth cam studs respectively. The connector system further includes a generally U-shaped second lever handle having legs slideably attached to both the third and fourth cam levers and a cross bar interconnecting the legs. Each leg of the second lever handle defines a slot. The third and fourth cam lever each include a flexible beam having a locking projection. The second lever handle is secured in the extended position when the locking projection is engaged within the slot. The second lever handle is slideable to the retracted position when the locking projection is disengaged from the slot. The first and second cam levers may rotate clockwise while the third and fourth cam levers rotate counterclockwise from an staged position to a mated position to move the second connector body linearly along the mating axis toward the first connector body.

The first connector body may include a third and fourth tab, each projecting parallel to the mating axis from opposing sides of the first connector body and configured to flex the flexible beams as the third and fourth cam levers are moved from an staged position to a mated position, thereby disengaging the locking projections from the slots. Each leg of the second lever handle includes a strap spanning each slot and wherein the third and fourth tabs are disposed intermediate the straps and the flexible beams when the third and fourth cam levers are in the mated position.

The first and second terminals may be electrical terminals. The second connector body may include electrical components such as fuses, relays, control modules, and diodes. The connector system may be disposed within a motor vehicle.

In accordance with another embodiment of the invention, a method of assembling a connector system is provided. The method includes the steps of providing a first connector body in which a first terminal is disposed and having a first and second cam stud, each projecting from opposing sides of the first connector body and providing a second connector body in which a second terminal configured to mate with the first terminal is disposed and having a first and second cam lever, each attached to opposite sides of the second connector body and rotatable about a first rotation axis that is orthogonal to a mating axis. The first and second cam levers each have a cam track configured to slidingly engage the first and second cam studs respectively, and a generally U-shaped first lever handle having legs slideably attached to both the first and second cam levers and a cross bar interconnecting the legs. Each leg of the first lever handle defines a slot. The first and second cam lever each include a flexible beam having a locking projection. The first lever handle is secured in an extended position when the locking projection is engaged within the slot and wherein the first lever handle is slideable to a retracted position when the locking projection is disengaged from the slot. The method further includes the steps of grasping the first lever handle while the locking projections are engaged within the slots and the first lever handle is in the extended position, pushing the first lever handle, thereby rotating the first and second cam levers from an staged position to a mated position, disengaging the locking projections from the slots by flexing the flexible beams, and moving the first lever handle from the extended position to the retracted position.

The first connector body may include a first and second tab, each projecting parallel to the mating axis from opposing sides of the first connector body and configured to flex the flexible beams as the first and second cam levers are moved from the staged position to the mated position, thereby disengaging the locking projections from the slots. Each leg of the first lever handle may include a strap spanning each slot. The first and second tabs are disposed intermediate the straps and the flexible beams when the first and second cam levers are in the mated position.

The connector system may further have a third and fourth cam stud, each projecting from opposing sides of the first connector body and a third and fourth cam lever, each attached to opposite sides of the second connector body and rotatable about a second rotation axis that is orthogonal to the mating axis. The third and fourth cam levers each have a cam track configured to slidingly engage the third and fourth cam studs respectively. The connector system also includes a generally U-shaped second lever handle having legs slideably attached to both the third and fourth cam levers and a cross bar interconnecting the legs. Each leg of the second lever handle defines a slot. The third and fourth cam lever each include a flexible beam having a locking projection. The second lever handle is secured in the extended position when the locking projection is engaged within the slot. The second lever handle is slideable to the retracted position when the locking projection is disengaged from the slot. The method may additionally include the steps of grasping the second lever handle while the locking projections are engaged within the slots and the second lever handle is in the extended position, pushing the second lever handle, thereby rotating the third and fourth cam levers from the staged position to the mated position, disengaging the locking projections from the slots by flexing the flexible beams, and moving the second lever handle from the extended position to the retracted position. The first and second cam levers rotate clockwise and the third and fourth cam levers rotate counterclockwise from the staged position to the mated position to move the second connector body linearly along the mating axis toward the first connector body.

The first connector body may include a third and fourth tab, each projecting parallel to the mating axis from opposing sides of the first connector body and configured to flex the flexible beams as the third and fourth cam levers are moved from the staged position to the mated position, thereby disengaging the locking projections from the slots. Each leg of the second lever handle may include a strap spanning each slot and wherein the third and fourth tabs are disposed intermediate the straps and the flexible beams when the third and fourth cam levers are in the mated position.

In accordance with yet another embodiment of the invention, a connector system is provided. The connector system includes a first connector body in which a first terminal is disposed and a second connector body in which a second terminal configure to mate with the first terminal is disposed. The second connector body is constructed and arranged to mate with the first connector body along a mating axis. A first and second cam stud each projecting from opposing sides of the first connector body. A first and second cam lever are each attached to opposite sides of the second connector body and are rotatable about a first rotation axis that is orthogonal to the mating axis. The first and second cam levers each have a cam track that is configured to slidingly engage the first and second cam studs respectively. A generally U-shaped first lever handle having legs and a cross bar interconnecting the legs is rotatably attached to both the first and second cam levers. The first lever handle is moveable from an extended position to a retracted position.

The connector system may further include a third and fourth cam stud, each projecting from opposing sides of the first connector body and a third and fourth cam lever, each attached to opposite sides of the second connector body and rotatable about a second rotation axis that is orthogonal to the mating axis. The third and fourth cam levers each have a cam track configured to slidingly engage the third and fourth cam studs respectively. The connector system also includes a generally U-shaped second lever handle having legs and a cross bar interconnecting the legs that is rotatably attached to both the third and fourth cam levers. The second lever handle is moveable from the extended position to the retracted position. The first and second cam levers rotate clockwise and the third and fourth cam levers rotate counterclockwise from an staged position to a mated position to move the second connector body linearly along the mating axis toward the first connector body.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
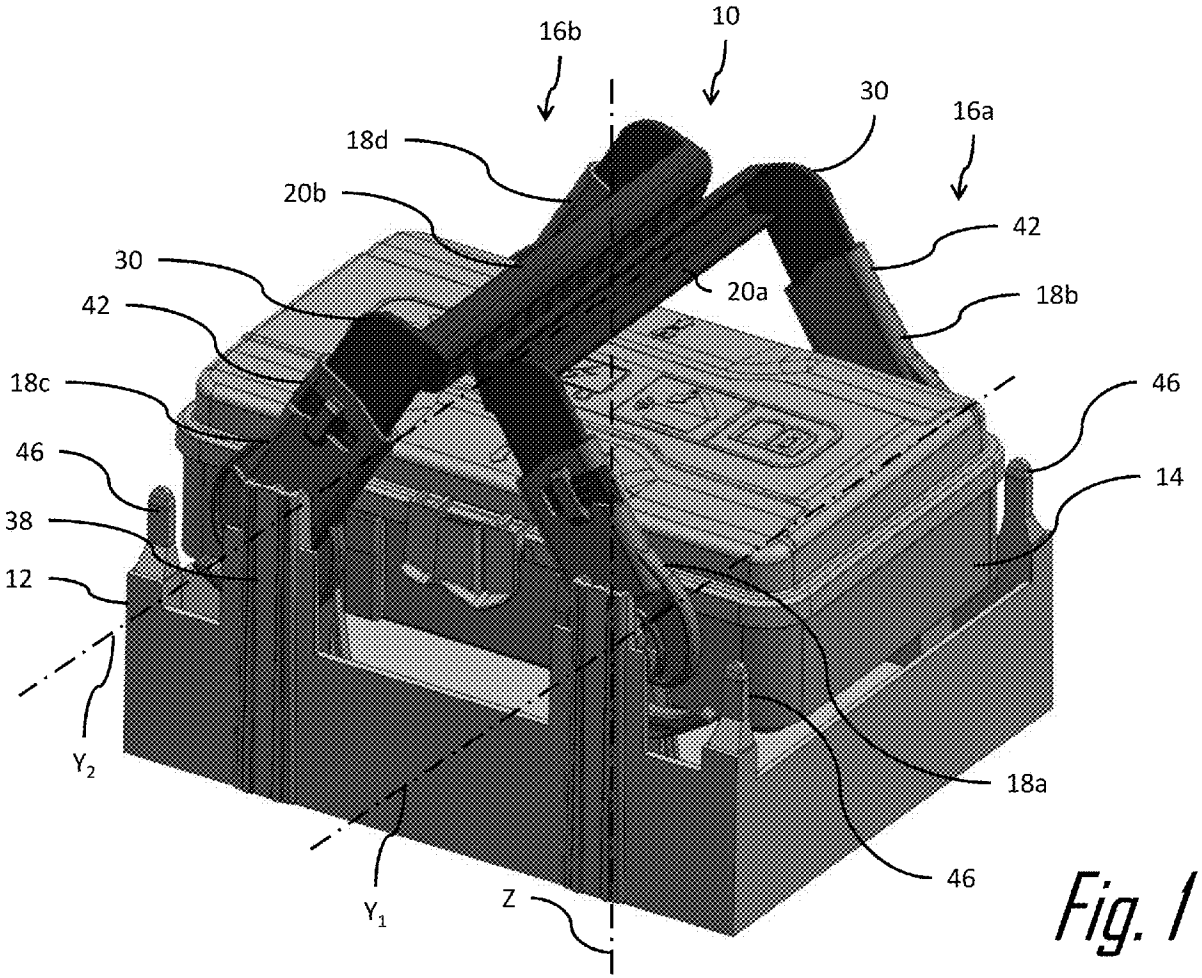
FIG. 1 is a perspective view of a connector system with cam levers in an staged position and lever handles in an extended position according to a first embodiment.

A connector system having a cam lever configured to assist the mating of two connector bodies and a method of assembling such a connector system is described herein. The cams levers are interconnected by a handle that can move along the cam levers and be locked in an extended position to increase the effective length of the cam levers, thereby requiring a lower force to be applied by an operator to assemble the connection system. As the connector bodies are fully mated, the handle is unlocked and can be moved from the extended position to a retracted position, thereby reducing the length of the cam levers and allowing the connection system to be more compactly packaged by providing smaller dimensions for the assembled connection system.

FIGS. 1 through 11 illustrate a non-limiting example of a connector system 10 which in the illustrated example is an electrical distribution center, but can also be any device which makes a connection including an electrical, optical, hydraulic, and/or pneumatic connector.

The connector system 10 includes a first connector body 12, hereinafter referred to as the base 12 that supports at least one electrical connector (not shown) having a plurality of electrical terminals (not shown) attached electrically at one end to respective wires of a wire harness (not shown) and engaged electrically at an opposite upward end to the respective terminals when the connector system 10 is mated. The connector system 10 further includes a second connector body 14, hereinafter referred to as an electrical panel 14 containing electrical components such as relays, fuses, control modules, diodes, and/or terminals.

The electrical panel 14 mates to the base 12 and thus the supported electrical connectors along a linear, central, mating axis Z by an assembler's, simultaneous, actuation of opposing lever devices 16 which are mounted rotatably to the electrical panel 14. Each lever device 16 rotates about a respective rotation axis $Y_1$, $Y_2$ which are disposed substantially orthogonally or perpendicular to the mating axis Z. The rotation axes $Y_1$, $Y_2$ are substantially parallel to one another and lie within a common imaginary plane also disposed substantially orthogonally to the mating axis Z. The two lever devices 16 are spaced substantially equally from the central mating axis Z and operate in reverse rotational directions from one another in order to cancel out rotational moments and producing a net force substantially oriented in the mating axis direction Z. This alleviates any lateral movement of the electrical panel 14 with respect to the central mating axis Z and any rotational movement of the electrical panel 14 and base 12 in the imaginary plane. With all motion thus concentrated along the mating axis Z, friction generally between the electrical panel 14 and the base 12 during the mating process is substantially reduced along with any possibility of misalignment of the terminals with the electrical connectors.

Figure 7:
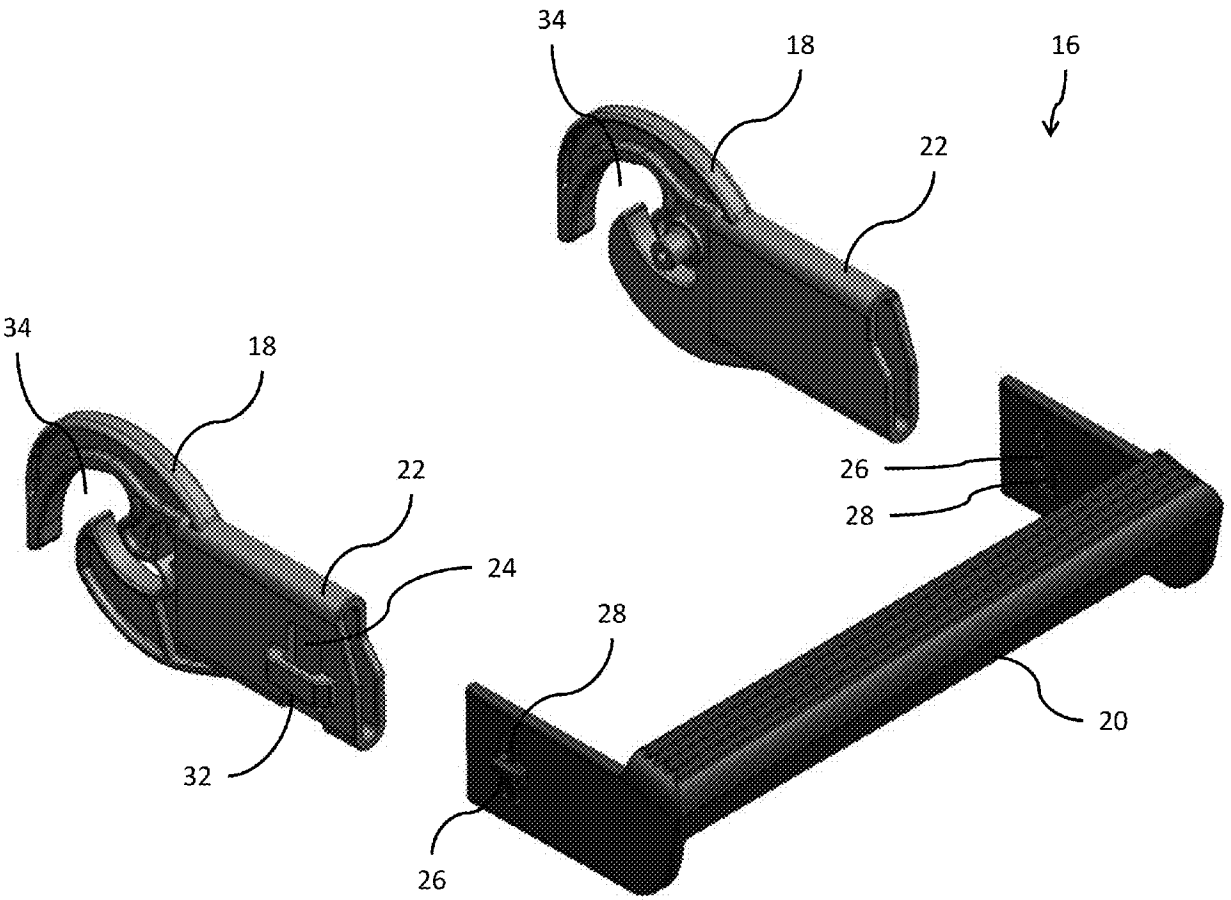
FIG. 7 is a perspective exploded view of the cam levers and the lever handle according to the first embodiment.
Figures 8A, 8B, 8C:
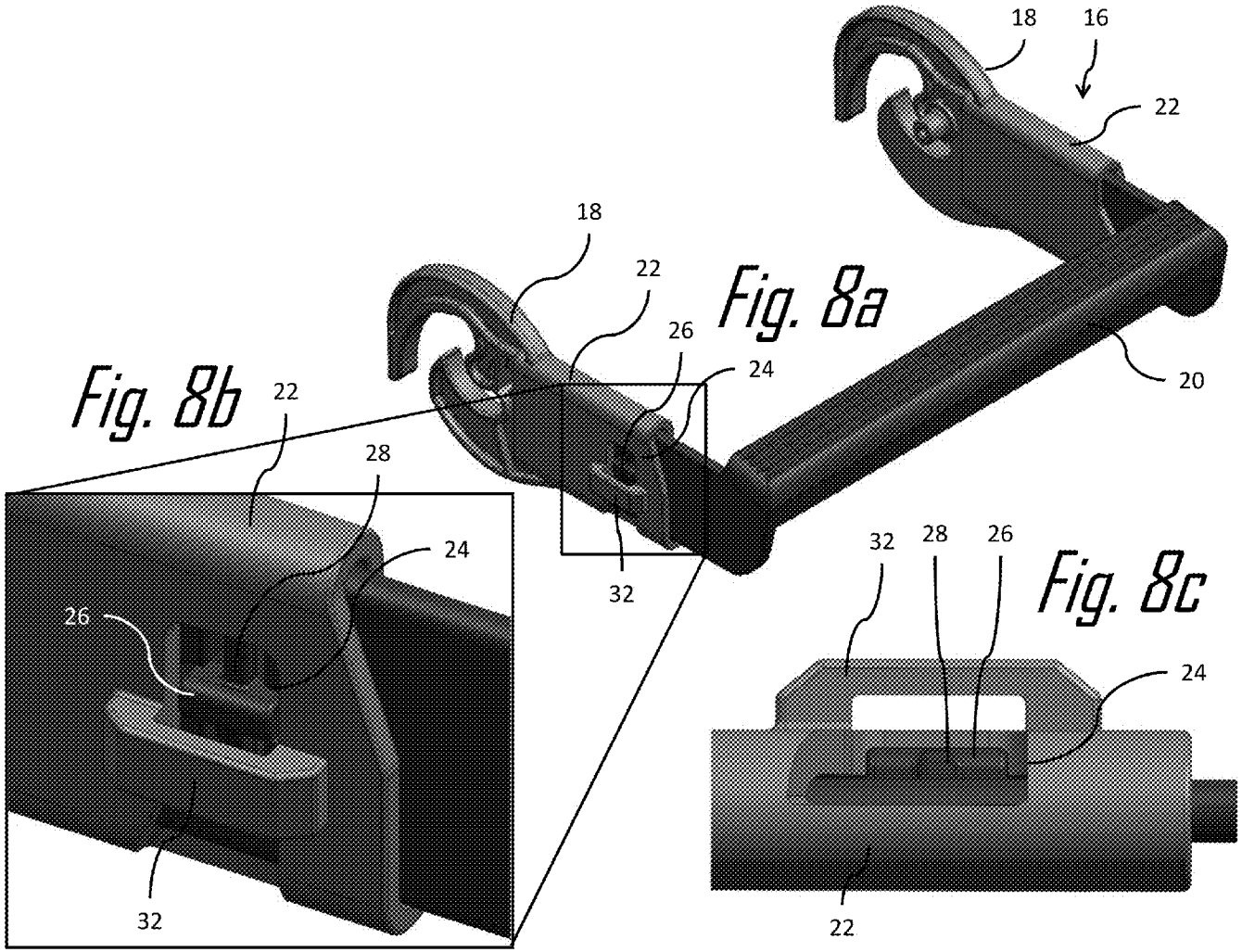
FIG. 8*a* is a perspective assembled view of the cam levers and lever handle according to the first embodiment.
FIG. 8*b* is a perspective close up view of a slot and strap of the cam levers and a flexible beam and locking projection of the lever handle according to the first embodiment.
FIG. 8*c* is a top close up view of the slot and strap of the cam levers and the flexible beam and locking projection of the lever handle according to the first embodiment.

In further regards to the generally diametrically opposed lever devices 16, each lever device 16 has a pair of cam levers 18 each having a radially outward projecting arm or elongated first section connected together at distal ends by a U-shaped handle 20 slideably attached to the pair of cam levers 18 and disposed substantially parallel to the rotation axes $Y_1$, $Y_2$. Legs 22 of the handle 20 define hollow sleeves into which the distal ends of the cam levers 18 are inserted. As shown in FIG. 7, each of the legs 22 define a rectangular locking slot 24 extending through an outer surface or each leg. The legs 22 include a rectangular locking projection 26 having a width that is slightly less than the width of the locking slots 24. These locking projections 26 are attached to flexible beams 28 defined by each of the cam levers 18. As best shown in FIGS. 8*a*-8*c*, when the handle 20 is in an extended position 30, the locking projections 26 are disposed within the locking slots 24 and edges of the locking projection 26 engage edges of the locking slot 24, thereby securing the handle 20 in the extended position 30. A strap 32 extends across each of the locking slots 24 in proximity to the location where the locking projections 26 are snapped into the locking slots 24.

Respective second sections of each cam lever 18 are substantially diametrically opposed to the elongated first sections and each define a cam track 34 for sliding contact with respective substantially cylindrical cam studs 36 projecting rigidly from the base 12. The cam track 34 of each cam lever 18 generally spirals radially inward toward the common rotation axis for the lever device 16 and the common rotation axis for the leveraging device. The first sections extend considerably further radially out from the respective rotation axis than the second sections thereby providing leveraging capability.

The first stud, engaged slideably to the first cam lever 18*a* of the first lever device 16*a*, projects generally inward from the first side wall 38 of the base 12 along a first centerline disposed substantially parallel to the first rotation axis $Y_1$. The second cam stud 36*b* engaged slideably to the second cam lever 18*b* of the first lever device 16*a* projects inward from the opposite second side wall 40 of the base 12 and along the same first centerline. Similarly, the third cam stud 36*c* engaged slideably to the third cam lever 18*c* of the second lever device 16*b* projects inward from the second side wall 40 of the base 12 along a second centerline disposed substantially parallel to the second rotation axis $Y_2$. The fourth cam stud 36*d* engages slideably to the fourth cam lever 18*d* of the second lever device 16*b* and projects inward from the first side wall 38 of the base 12 and along the same second centerline.

Figure 2:
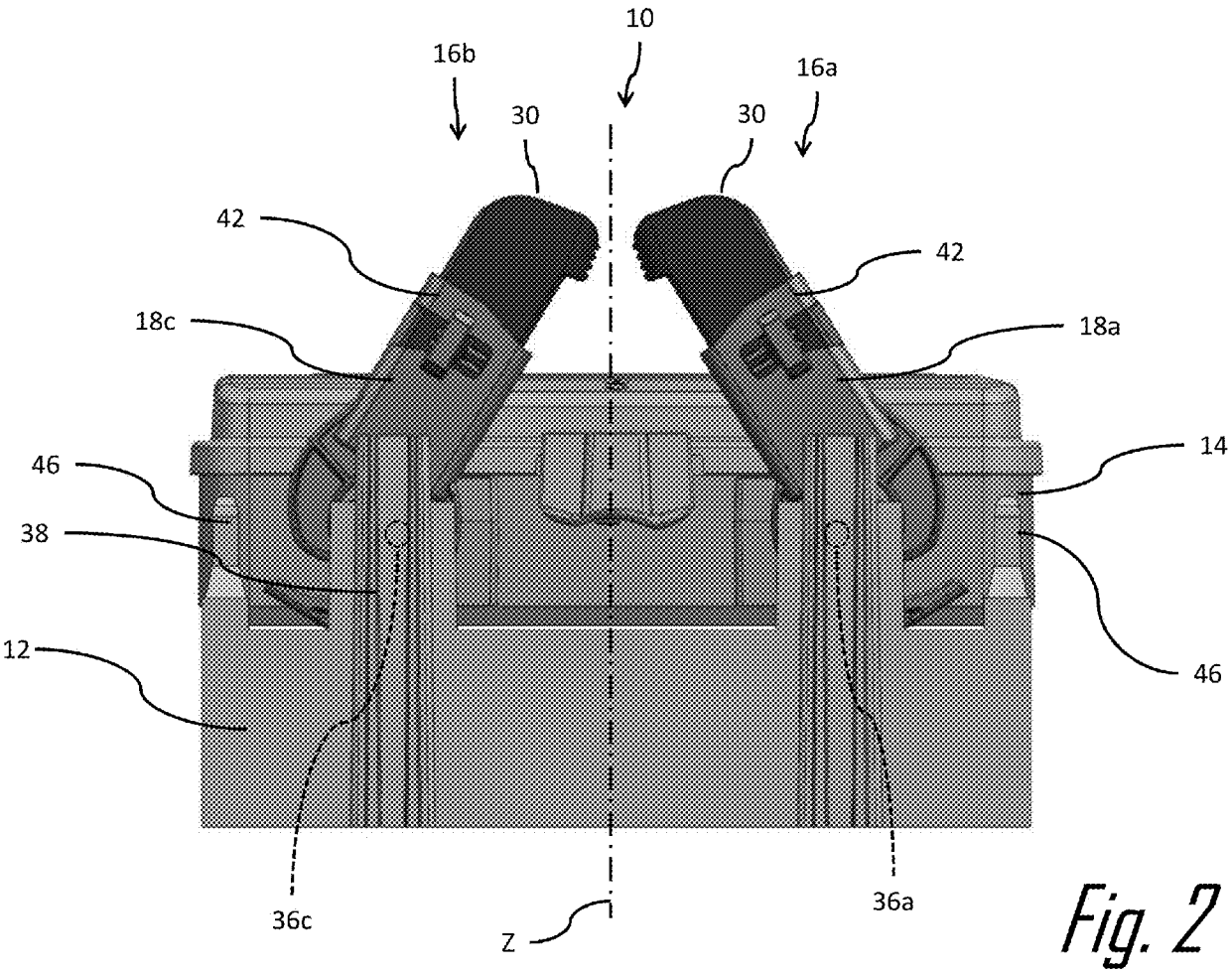
FIG. 2 is a side view of the connector system of FIG. 1 with the cam levers in the staged position and the lever handles in an extended position according to the first embodiment.
Figure 3:
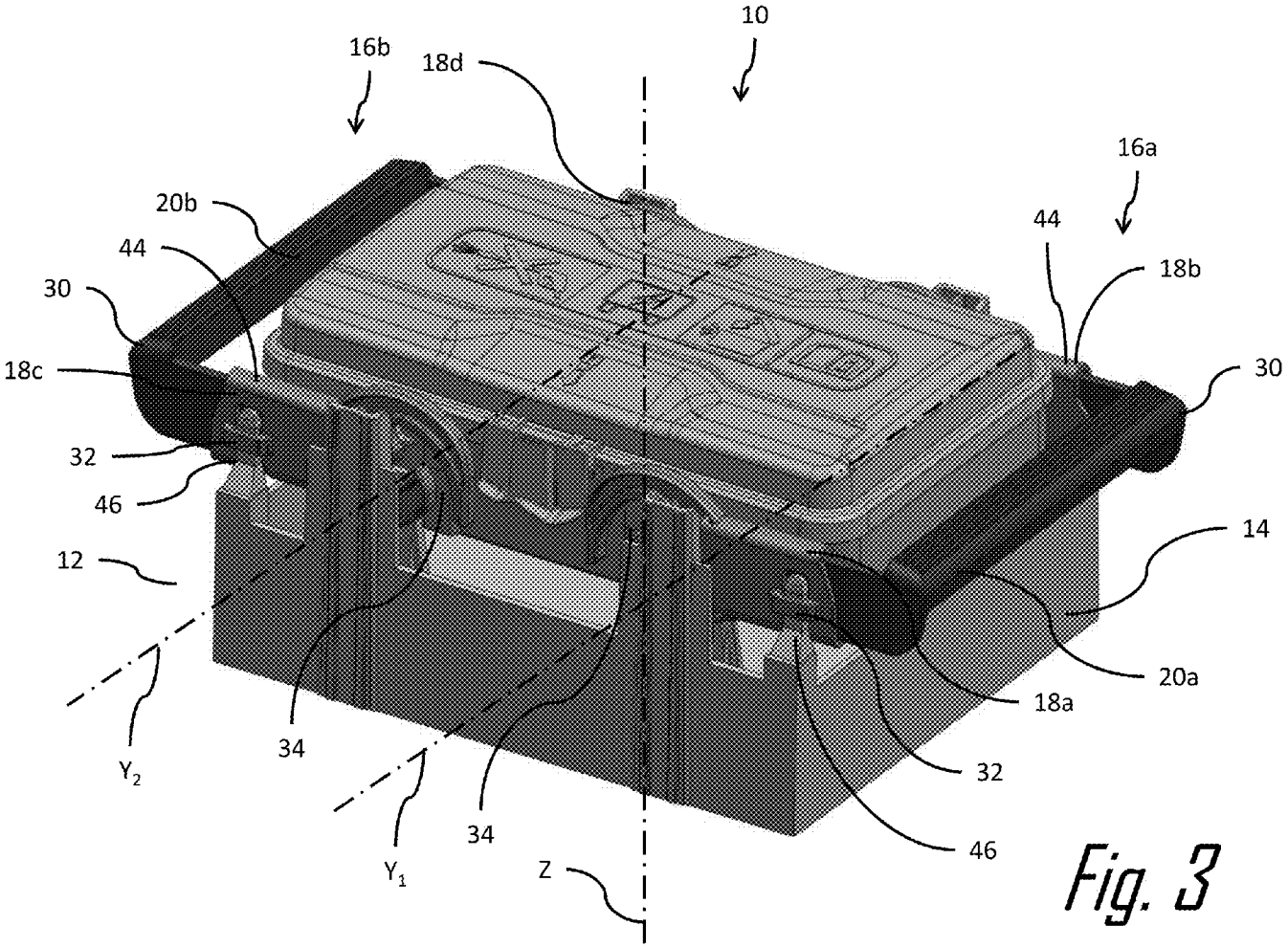
FIG. 3 is a perspective view of the connector system of FIG. 1 with the cam levers in a mated position and the lever handles in the extended position according to the first embodiment.
Figure 4:
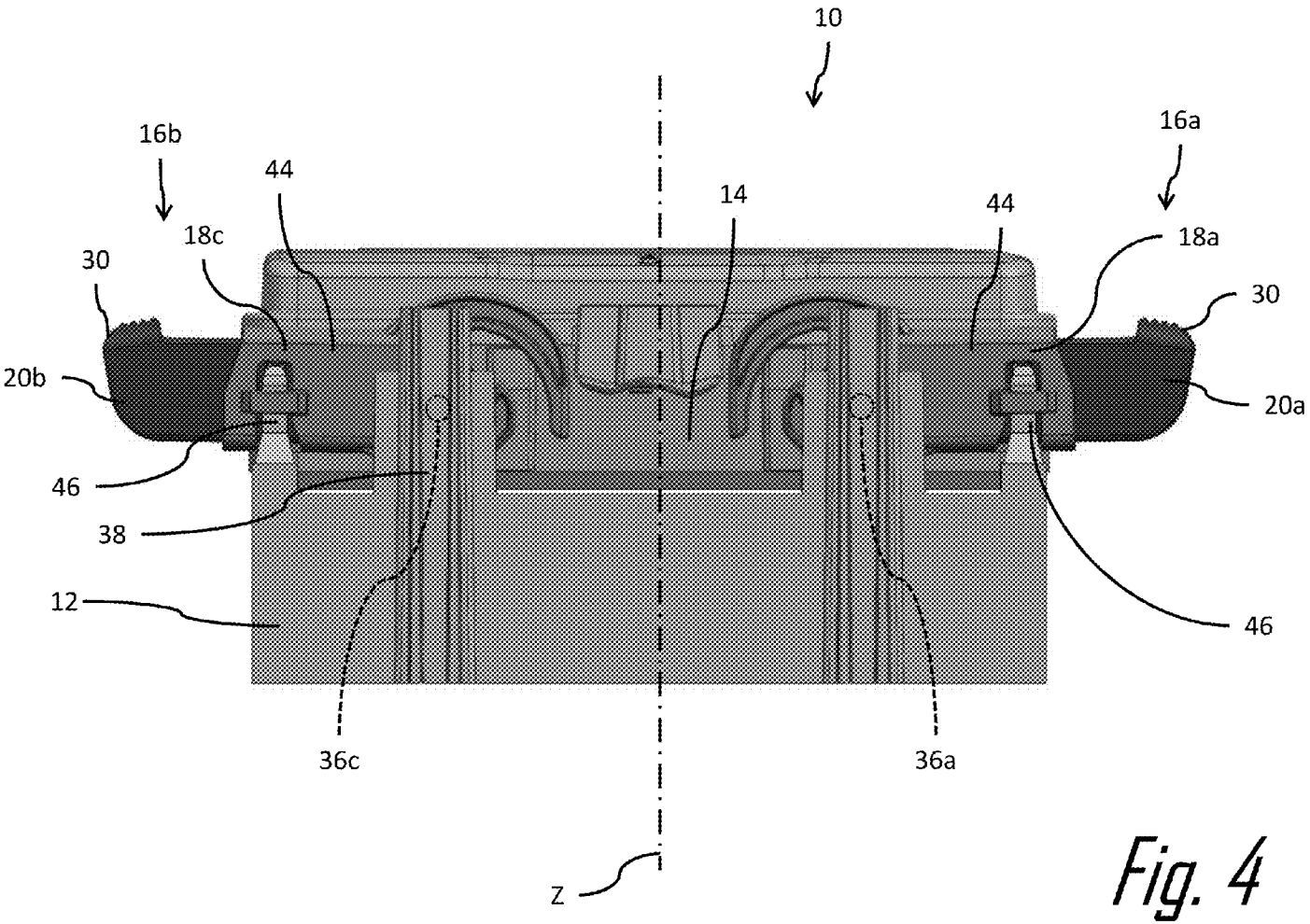
FIG. 4 is a side view of the connector system of FIG. 1 with the cam levers in a mated position and the lever handles in the extended position according to the first embodiment.
Figure 5:
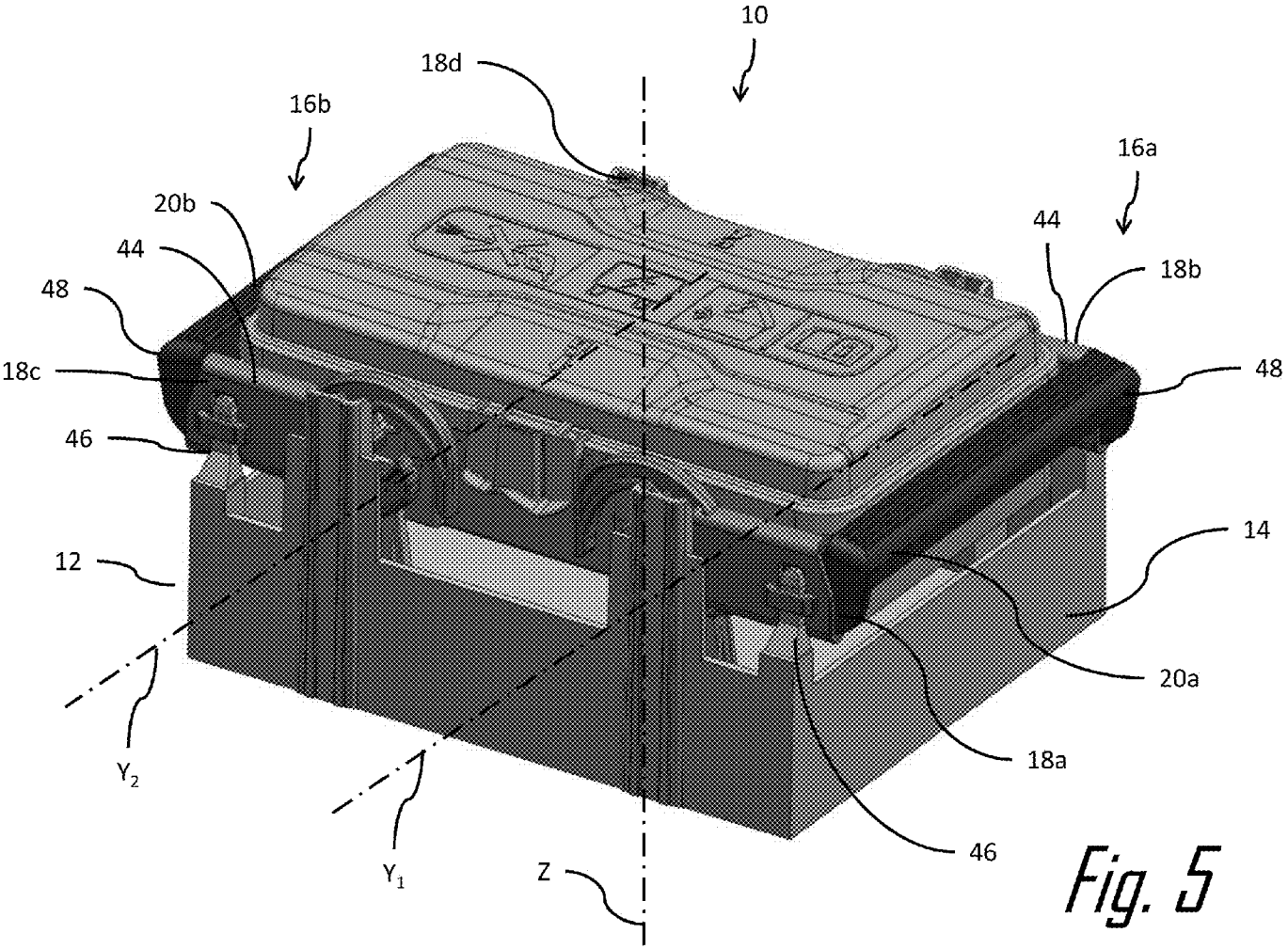
FIG. 5 is a perspective view of the connector system of FIG. 1 with the cam levers in a mated position and the lever handles in a retracted position according to the first embodiment.
Figure 6:
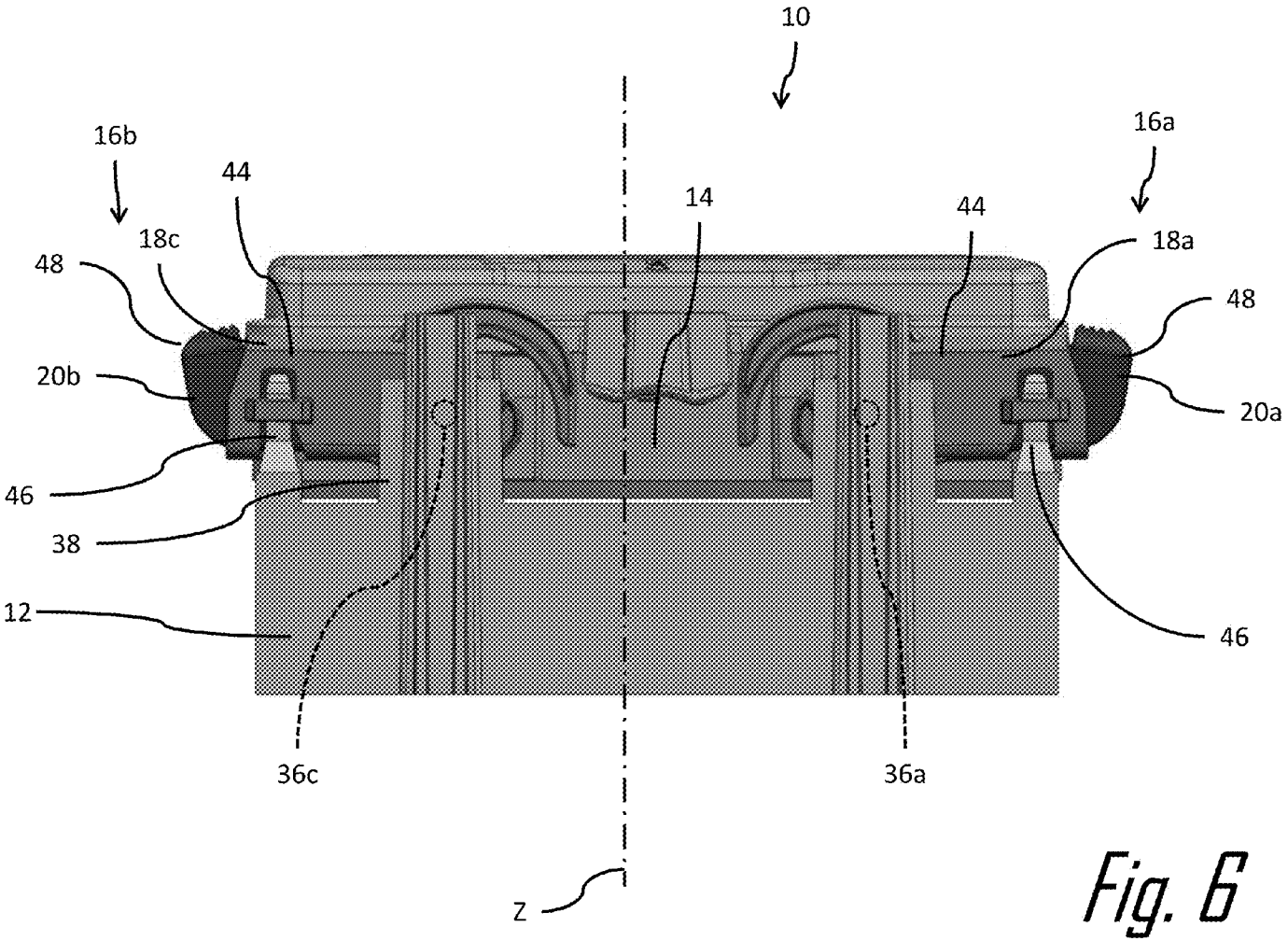
FIG. 6 is a side view of the connector system of FIG. 1 with the cam levers in a mated position and the lever handles in the retracted position according to the first embodiment.

During the mating process, the electrical panel 14 generally moves linearly along the mating axis Z from a staged position 42 (as best illustrated in FIGS. 1 and 2) to a mated position 44 (as best illustrated in FIGS. 3 and 4). A first portion of the cam track 34 spirals radially inward with respect to the rotation axis $Y_1$ or $Y_2$ from a receiving or distal end to a staged end. The first portion of the cam track 34 is carried by a hook segment of the second section and generally faces toward the rotation axis $Y_1$ or $Y_2$. A claw segment of the second section and the first portion of the cam tracks define an outer slot having an opening at the receiving end of the cam tracks for initially accepting the respective cam studs 36. In general, the claw segment circumferentially curves or spirals in an opposite direction than the hook segment. A second portion of the cam track 34 also spirals radially inward with respect to the rotation axis $Y_1$ or $Y_2$ but in an opposite circumferential direction than the first portion, and from a catch end to a mated end. The catch end is generally disconnected from the staged end of the first portion and is spaced from the staged end by a distance greater than the diameter of the cam studs 36. The catch end is positioned to generally face both the rotation axis $Y_1$ or $Y_2$ and the staged end of the first portion. The second portion of the cam tracks is carried by the claw segment of the second section and generally faces toward the rotation axis $Y_1$ or $Y_2$.

To linearly move the electrical panel 14 along the mating axis Z to the staged position 42, opposing lever devices 16 are appropriately rotated to align the openings of the cam tracks to the cam studs 36. Once aligned, the first lever device 16*a* is rotated in a counterclockwise direction and the second lever device 16*b* is rotated in a clockwise direction so that the handles 20 are located near one another in the staged position 42 as shown in FIGS. 1 and 2. The handles 20 are preferably in the extended position 30 at this time. During this initial rotation of about eighty to one hundred degrees, the cam studs 36 slide along the first portions of the cam tracks 34 until they abut the staged end stopping the rotational motion of the leverage devices and indicating that the electrical panel 14 is in the staged position 42.

To linearly move the electrical panel 14 along the mating axis Z from the staged position 42 to the mated position 44, the assembler moves the handles 20 in an opposite rotational direction, i.e., the first lever device 16*a* is rotated in a clockwise direction and the second lever device 16*b* is rotated in a counterclockwise direction, and generally away from one-another from the staged position 42 to the mated position 44. The handles 20 are preferably in the extended position 30 during this procedure, thereby reducing the force required to be applied to the handles 20 in order to rotate the cam levers 18 to the mated position 44. This rotates the respective cam levers 18 about the respective rotation axes $Y_1$, $Y_2$ causing the cam studs 36 to lift off of the staged end of the first portion of the cam tracks and catching the studs at the respective catch ends of the second portions of the cam tracks. The cam studs 36 then slide along the second portion until they abut the mated end of the second portion indicating that the mated position 44 of the electrical panel 14 with the base 12 has been reached. When in the mated position 44, the handles 20 are at a maximum distance away from one-another and orientated substantially flush with a top surface or rim of the electrical panel 14. To protect the electrical components, protruding upward from the top surface, a cover snap fits over the electrical panel 14 and about the exterior walls of the base 12.

The second section of the respective cam levers 18 carry a third portion of the cam tracks 34 which faces substantially radially outward and generally opposes the second portion. The third portion extends between the mated end of the second portion and the staged end of the first portion. An inner slot which communicates with the outer slot at the staged end is generally defined by the second portion and third portion of the cam tracks. It is within the inner slot that the cam stud moves when the electrical panel 14 moves along the mating axis Z between the mated position 44 and staged position 42. When the assembler moves the handles 20 toward one another, the cam studs 36 lift off of the respective mated end of the second portion of the cam tracks and slide along the third portion until the outer slot is reached. At this point, the electrical panel 14 can be lifted away from the base 12.

The staged end of the first portion of the cam tracks 34 is a concave face which opens radially outward with respect to the respective rotation axes. The congruent formation between the concave face and the third portion forms an apex which points generally radially outward and prevents the cam stud from inadvertently sliding into the inner slot when the electrical panel 14 is intended to remain in the staged position 42. Further details regarding the interaction of the cam tracks 34 with the cam studs 36 may be found in U.S. Pat. No. 7,094,081, the entire disclosure of which is hereby incorporated by reference.

The base 12, lever devices 16, and electrical panel 14 (except for the male terminal blades), are all made of an electrically insulating and corrosion resistant material such as injection molded plastic.

Figure 9:
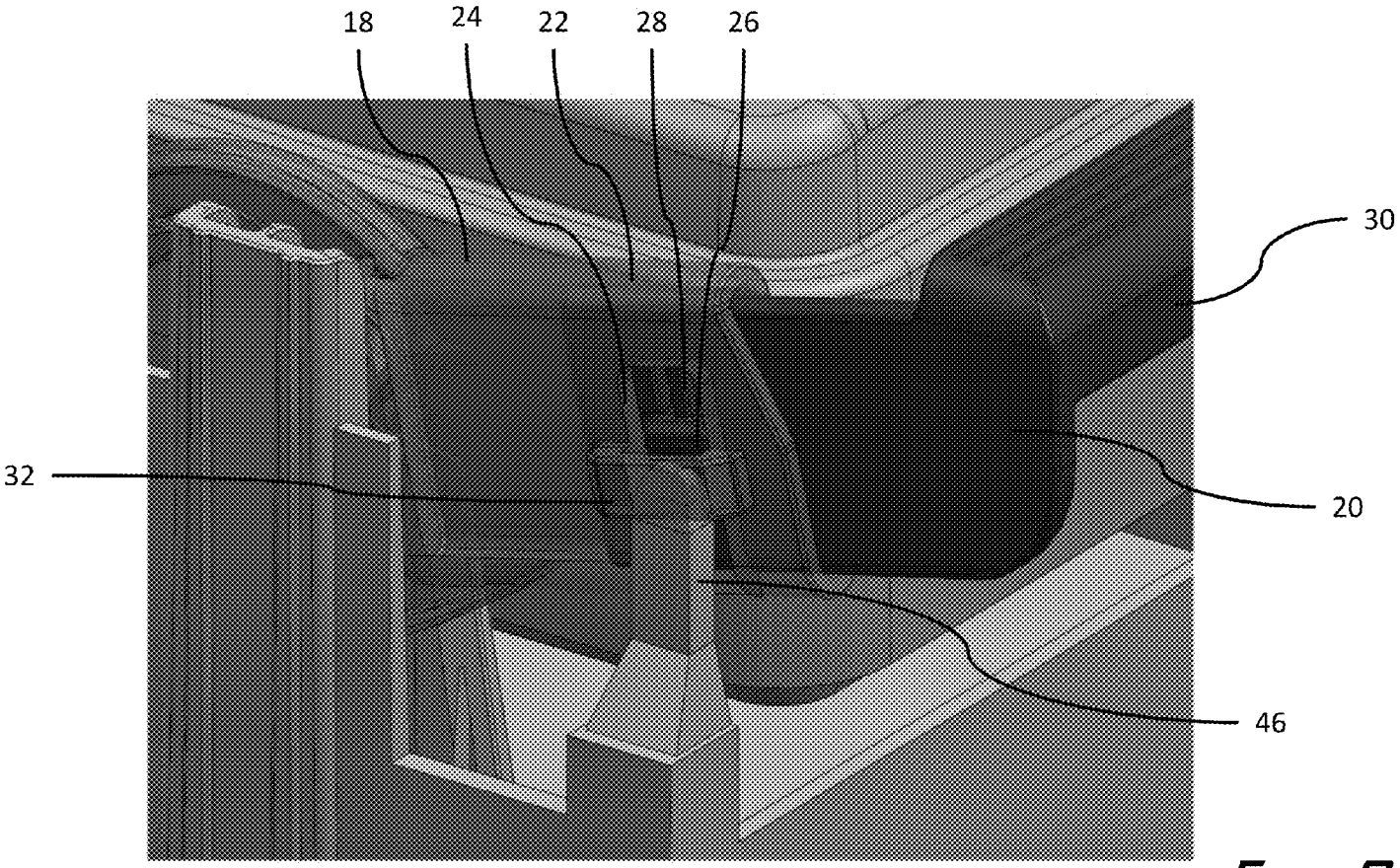
FIG. 9 is a perspective close up view of a tab contacting a locking projection on the flexible beam as the cam levers approach the mated position according to the first embodiment.
Figure 10:
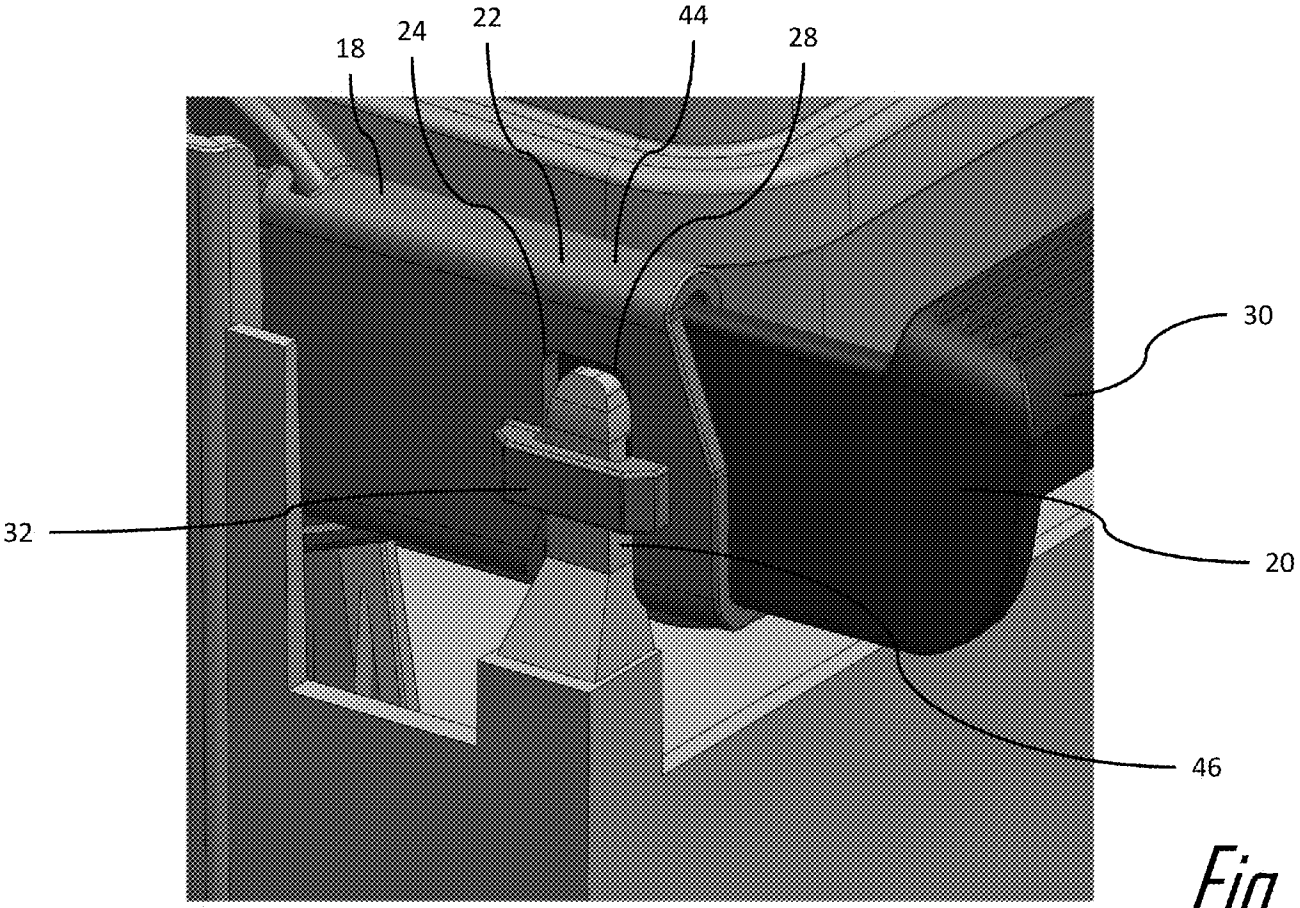
FIG. 10 is a perspective close up view of the tab contacting the locking projection on the flexible beam when the cam levers are in the mated position and the lever handles are in the extended position according to the first embodiment.
Figure 11:
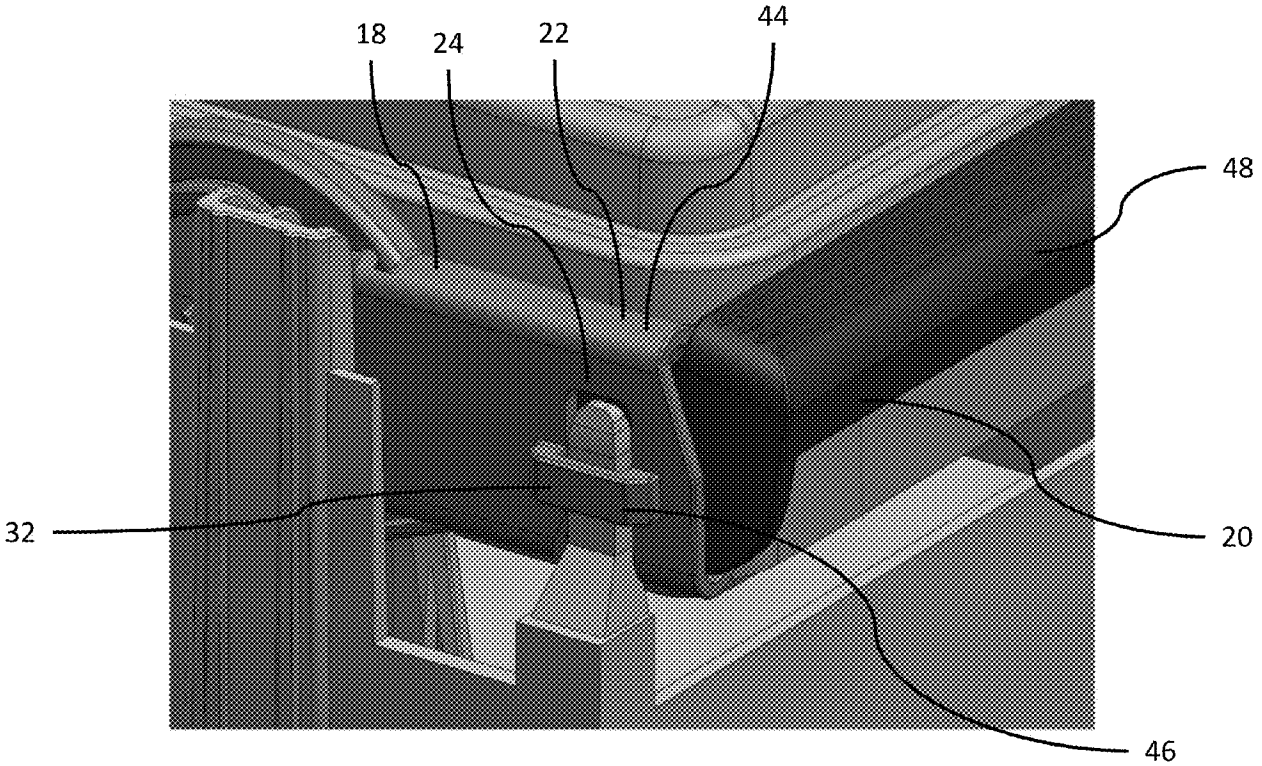
FIG. 11 is a perspective close up view of the tab when the cam levers are in the mated position and the lever handles are in the retracted position according to the first embodiment.

Referring particularly to FIGS. 9 through 11, as the cam levers 18 are moved from the staged position to the mated position, tapered tabs 46 which project upwardly from the base 12 are positioned in the locking slots 24 of the cam levers 18 intermediate the straps 32 and the locking projections 26. The tapered tabs push against the locking projection 26 causing the flexible beam 28 to flex inwardly so that the edges of the locking projections 26 no longer engage the edges of the locking slots 24. Since these edges are no longer engaged, the handles 20 may be pushed inwardly to a retracted position 48 as shown in FIG. 11. The straps 32 provide support to the tapered tabs 46 to inhibit the tabs 46 from flexing outwardly when pressing against the locking projections 26.

While the locking slots 24 and locking projections 26 illustrated in FIGS. 1-11 have a rectangular shape, other embodiments having locking slots and corresponding locking projections with other shapes such as square, triangular, round, or oval may also be envisioned.

Figure 12:
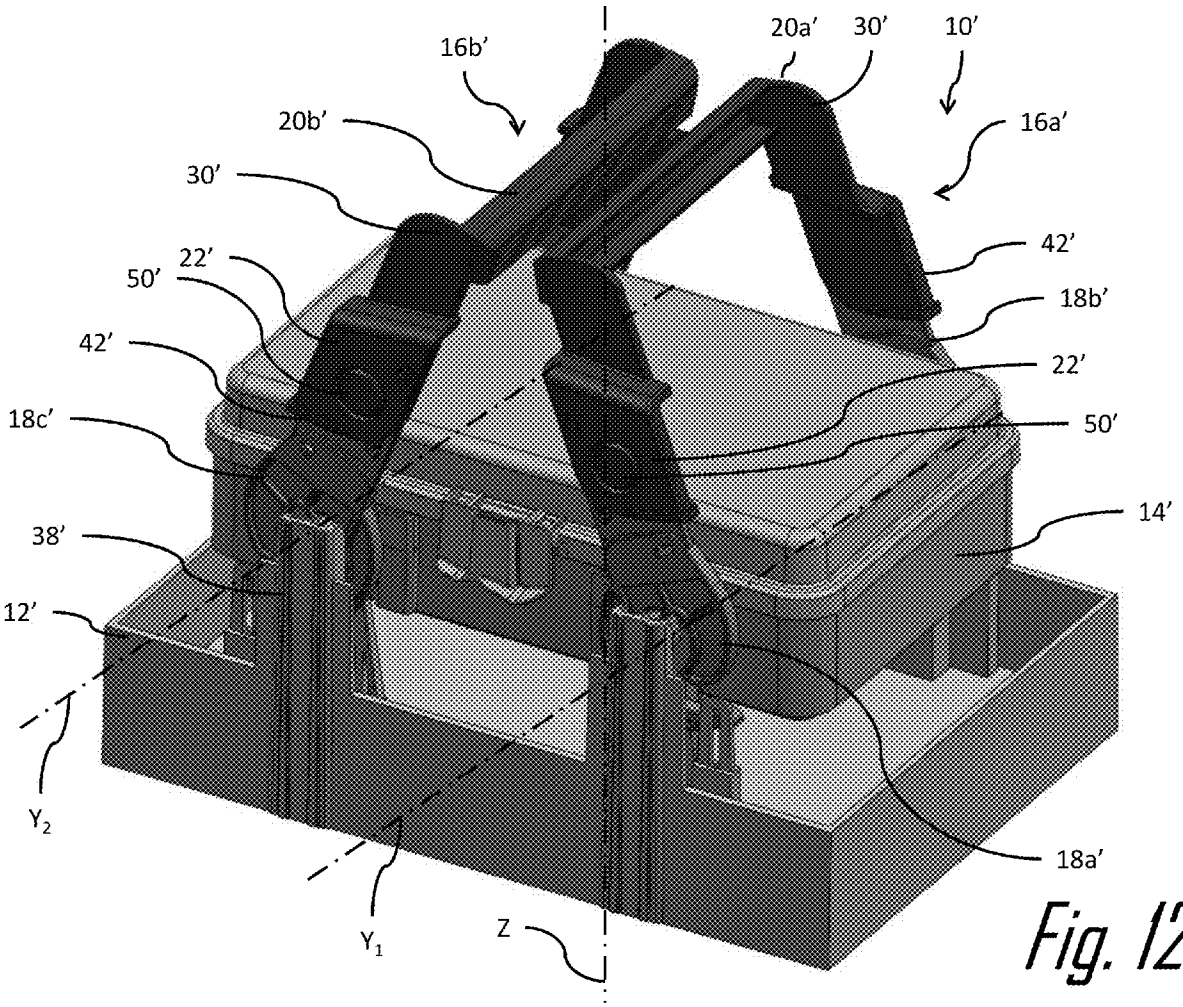
FIG. 12 is a perspective view of a connector system with cam levers in an staged position and lever handles in an extended position according to a second embodiment.
Figure 13:
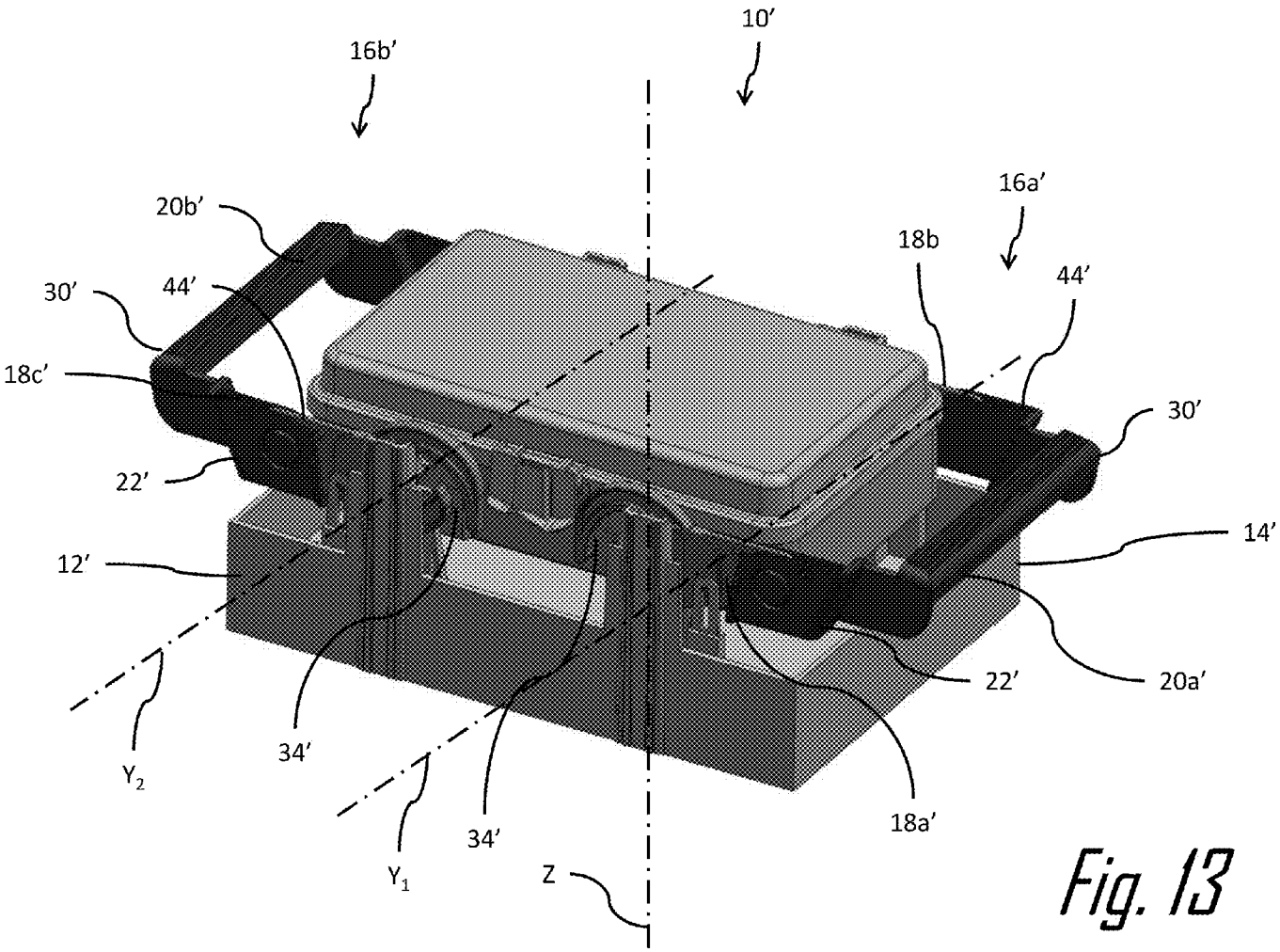
FIG. 13 is a perspective view of the connector system of FIG. 12 with the cam levers in a mated position and the lever handles in the extended position according to the second embodiment.
Figure 14:
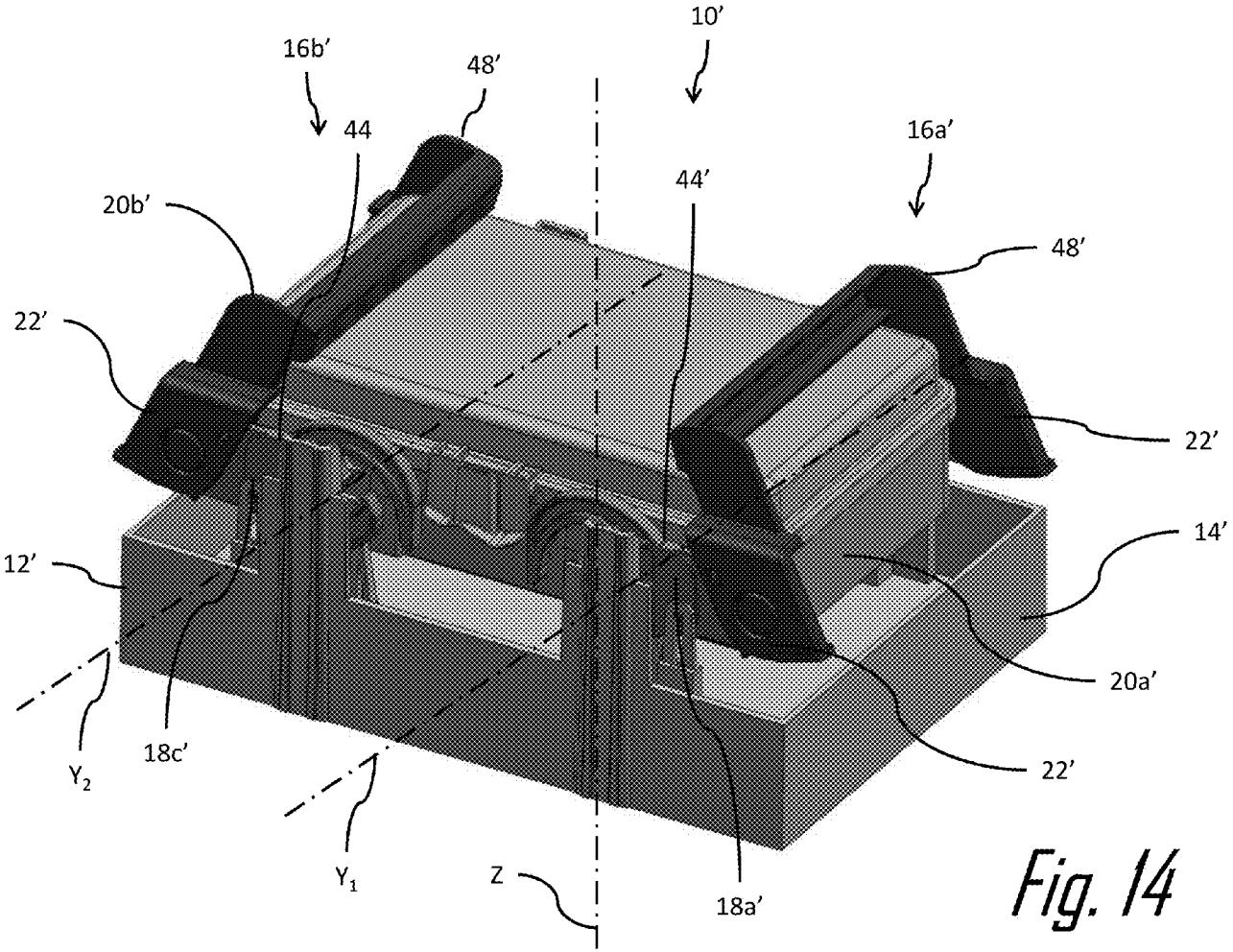
FIG. 14 is a perspective view of the connector system of FIG. 12 with the cam levers in a mated position and the lever handles in a retracted position according to the second embodiment.

FIGS. 12 through 14 illustrate another non-limiting example of a connector system 10' similar to the embodiment described above except that the handles 20*a*', 20*b*' are rotatably attached rather than slideably attached to the cam levers 18'. The reference numbers of elements similar to the previously described embodiment are the same with the addition of a prime mark (') . The handles 20*a*', 20*b*' have U-shaped legs 22' into which the cam levers 18' are received. The legs 22' are attached by pivots 50' to the cam levers 18'. As shown in FIGS. 12-14, the closed portion of the legs 22' contact the cam levers 18' as they are moved from the staged position 42' to the mated position 44'. Once the cam levers 18' are in the mated position 44', the open portion of the legs 22' allow the handles 20*a*', 20*b*' to be folded from an extended position 30' to a retracted position 48'.

Figure 15:
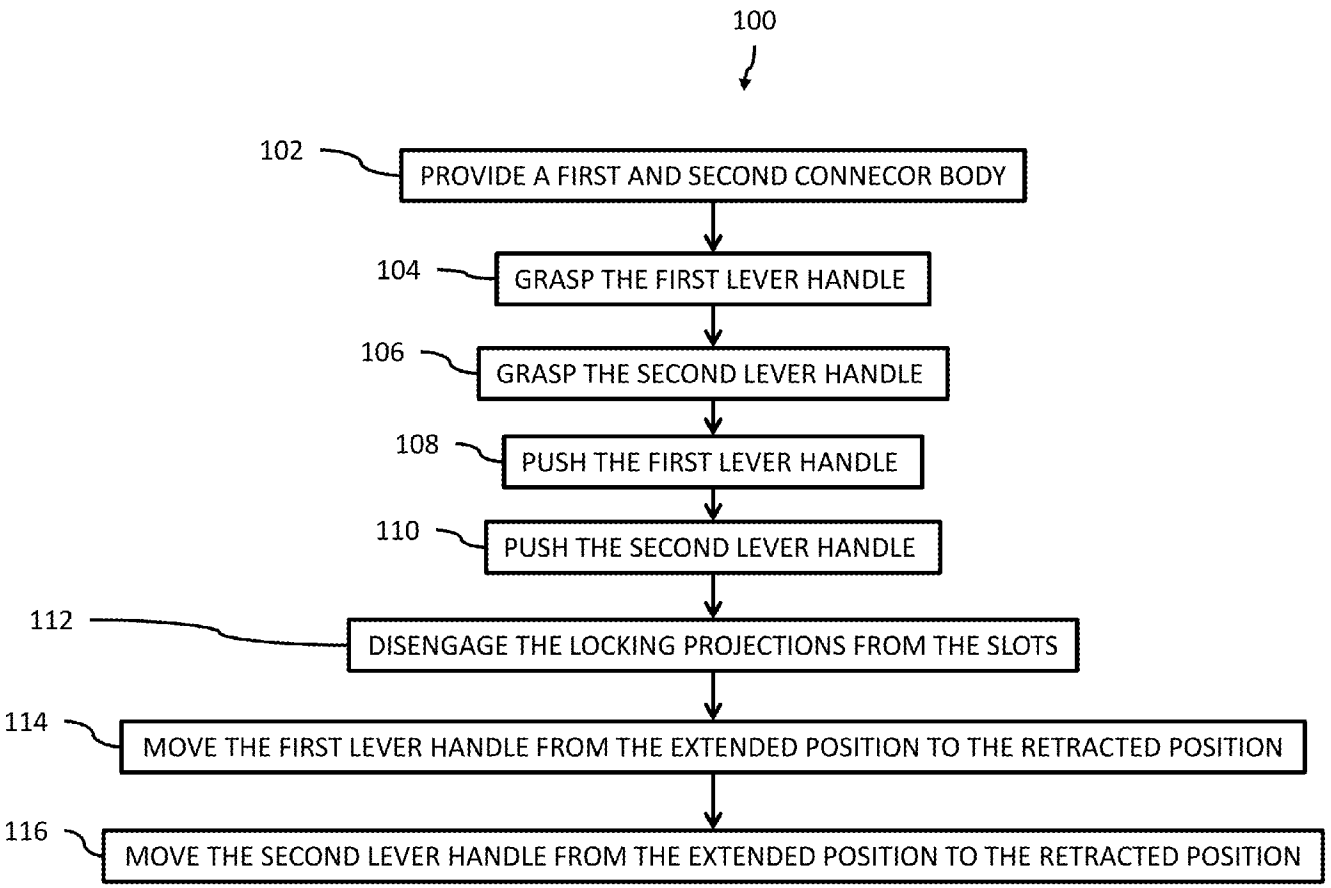
FIG. 15 is a flow chart of a method of assembling a connector system according to a third embodiment.

A method 100 of assembling a connector system 10 is presented in FIG. 15. The steps of this method 100 are described below:

STEP 102, PROVIDE A FIRST AND SECOND CONNECTOR BODY, includes providing a first connector body 12 in which a first terminal is disposed and having a first and second cam stud, each projecting from opposing sides of the first connector body 12 and providing a second connector body 14 in which a second terminal configured to mate with the first terminal is disposed and having a first and second cam lever 18*a*, 18*b*, each attached to opposite sides of the second connector body 14 and rotatable about a first rotation axis that is orthogonal to a mating axis. The first and second cam levers 18*a*, 18*b* each have a cam track 34 configured to slidingly engage the first and second cam studs 36*a*, 36*b* respectively, and a generally U-shaped first lever handle 20*a* having legs 22 slideably attached to both the first and second cam levers 18*a*, 18*b* and a cross bar interconnecting the legs 22. Each leg 22 of the first lever handle 20*a* defines a locking slot 24. The first and second cam lever 18*a*, 18*b* each include a flexible beam 28 having a locking projection 26. The first lever handle 20*a* is secured in an extended position 30 when the locking projection 26 is engaged within the locking slot 24 and wherein the first lever handle 20*a* is slideable to a retracted position 48 when the locking projection 26 is disengaged from the locking slot 24. The connector system 10 may further have a third and fourth cam stud, each projecting from opposing sides of the first connector body 12 and a third and fourth cam lever 18*c*, 18*d*, each attached to opposite sides of the second connector body 14 and rotatable about a second rotation axis that is orthogonal to the mating axis. The third and fourth cam levers 18*c*, 18*d* each have a cam track 34 configured to slidingly engage the third and fourth cam studs 36*c*, 36*d* respectively. The connector system 10 also includes a generally U-shaped second lever handle 20*a* having legs 22 slideably attached to both the third and fourth cam levers 18*c*, 18*d* and a cross bar interconnecting the legs 22. Each leg 22 of the second lever handle 20*a* defines a locking slot 24. The third and fourth cam levers 18*c*, 18*d* each include a flexible beam 28 having a locking projection 26. The second lever handle 20*a* is secured in the extended position 30 when the locking projection 26 is engaged within the locking slot 24. The second lever handle 20*a* is slideable to the retracted position 48 when the locking projection 26 is disengaged from the locking slot 24;

STEP 104, GRASP THE FIRST HANDLE, includes grasping the first lever handle 20*a* while the locking projections 26 are engaged within the locking slots 24 and the first lever handle 20*a* is in the extended position 30;

STEP 106, GRASP THE SECOND HANDLE, is an optional step that includes grasping the second lever handle 20*a* while the locking projections 26 are engaged within the locking slots 24 and the second lever handle 20*a* is in the extended position 30;

STEP 108, PUSH THE FIRST HANDLE, includes pushing the first lever handle, thereby rotating the first cam lever 18*a* from an staged position 42 to a mated position 44;

STEP 110, PUSH THE SECOND HANDLE, is an optional step that includes pushing the second lever handle 20*a*, thereby rotating the second cam lever 18*b* from the staged position 42 to the mated position 44;

STEP 112, DISENGAGE THE LOCKING PROJECTIONS FROM THE SLOTS, includes disengaging the locking projections 26 from the locking slots 24 by flexing the flexible beams 28, and moving the first lever handle 20*a* from the extended position 30 to the retracted position 48;

STEP 114, MOVE THE FIRST LEVER HANDLE FROM THE EXTENDED POSITION TO THE RETRACTED POSITION, includes moving the first lever handle 20*a* from the extended position 30 to the retracted position 48; and STEP 116, MOVE THE SECOND LEVER HANDLE FROM THE EXTENDED POSITION TO THE RETRACTED POSITION, includes moving the second lever handle 20*a* from the extended position 30 to the retracted position 48.

Therefore a connector system 10, 10' and a method 100 of assembling a connector system 10 is provided. The connector system 10 includes lever devices 16, 16' to assist in mating the connector bodies 12, 14 of the connector system 10. These lever devices 16, 16' have handles 20, 20' that be extended to provide additional leverage while the connector bodies 12, 14 are being mated and retracted to provide a smaller packaging size for the connector assembly 10. The handles 20, 20' may be configured to slide or rotate relative to the cam levers 18, 18'.

While the examples presented herein are directed to electrical connector systems, other embodiments of the connector system 10 may be envisioned that are adapted for use with optical cable terminals or hybrid connections including both electrical and optical cable terminals. Yet other embodiments of the connector system 10 may be envisioned that are configured for connecting fittings at the ends of pneumatic or hydraulic lines.

While this invention has been described in terms of the preferred embodiments thereof, it is not intended to be so limited, but rather only to the extent set forth in the claims that follow. Moreover, the use of the terms first, second, primary secondary, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. A connector system, comprising:

a first connector body in which a first terminal is disposed;

a second connector body in which a second terminal configure to mate with the first terminal is disposed, said second connector body constructed and arranged to mate with the first connector body along a mating axis;

a first and second cam stud, each projecting from opposing sides of the first connector body;

a first and second cam lever, each attached to opposite sides of the second connector body and rotatable about a first rotation axis that is orthogonal to the mating axis, wherein the first and second cam levers each have a cam track configured to slidingly engage the first and second cam studs respectively;

a generally U-shaped first lever handle having legs slideably attached to both the first and second cam levers and a cross bar interconnecting the legs, wherein each leg of the first lever handle defines a slot, wherein the first and second cam lever each include a flexible beam having a locking projection, and wherein the first lever handle is secured in an extended position when the locking projection is engaged within the slot and wherein the first lever handle is slideable to a retracted position when the locking projection is disengaged from the slot, wherein the first connector body includes a first tab and a second tab each projecting parallel to the mating axis from opposite sides of the first connector body and configured to flex the flexible beams as the first and second cam levers are moved from an open to a mated position, thereby disengaging the locking projections from the slots.

2. The connector system according to claim 1, wherein each leg of the first lever handle includes a strap spanning each slot and wherein the first and second tabs are disposed intermediate the straps and the flexible beams when the first and second cam levers are in the mated position.

3. The connector system according to claim 1, further comprising:

a third and fourth cam stud, each projecting from opposing sides of the first connector body;

a third and fourth cam lever, each attached to opposite sides of the second connector body and rotatable about a second rotation axis that is orthogonal to the mating axis, wherein the third and fourth cam levers each have a cam track configured to slidingly engage the third and fourth cam studs respectively;

a generally U-shaped second lever handle having legs slideably attached to both the third and fourth cam levers and a cross bar interconnecting the legs, wherein each leg of the second lever handle defines a slot, wherein the third and fourth cam lever each include a flexible beam having a locking projection, wherein the second lever handle is secured in the extended position when the locking projection is engaged within the slot and wherein the second lever handle is slideable to the retracted position when the locking projection is disengaged from the slot, and wherein the first and second cam levers rotate clockwise and the third and fourth cam levers rotate counterclockwise from an staged position to a mated position to move the second connector body linearly along the mating axis toward the first connector body.

4. The connector system according to claim 3, wherein the first connector body includes a third and fourth tab, each projecting parallel to the mating axis from opposing sides of the first connector body and configured to flex the flexible beams as the third and fourth cam levers are moved from an staged position to a mated position, thereby disengaging the locking projections from the slots.

5. The connector system according to claim 4, wherein each leg of the second lever handle includes a strap spanning each slot and wherein the third and fourth tabs are disposed intermediate the straps and the flexible beams when the third and fourth cam levers are in the mated position.

6. The connector system according to claim 1, wherein the first and second terminals are electrical terminals.

7. The connector system according to claim 6, wherein the second connector body includes electrical components.

8. The connector system according to claim 7, wherein the electrical components are selected from the group consisting of fuses, relays, control modules, and diodes.

9. The connector system according to claim 6, wherein the connector system is disposed within a motor vehicle.

10. A method of assembling a connector system, comprising the steps of:

providing a first connector body in which a first terminal is disposed and having a first and second cam stud, each projecting from opposing sides of the first connector body;

providing a second connector body in which a second terminal configured to mate with the first terminal is disposed and having a first and second cam lever, each attached to opposite sides of the second connector body and rotatable about a first rotation axis that is orthogonal to a mating axis, wherein the first and second cam levers each have a cam track configured to slidingly engage the first and second cam studs respectively, and a generally U-shaped first lever handle having legs slideably attached to both the first and second cam levers and a cross bar interconnecting the legs, wherein each leg of the first lever handle defines a slot, wherein the first and second cam lever each include a flexible beam having a locking projection, and wherein the first lever handle is secured in an extended position when the locking projection is engaged within the slot and wherein the first lever handle is slideable to a retracted position when the locking projection is disengaged from the slot;

grasping the first lever handle while the locking projections are engaged within the slots and the first lever handle is in the extended position;

pushing the first lever handle, thereby rotating the first and second cam levers from an staged position to a mated position;

disengaging the locking projections from the slots by flexing the flexible beams; and moving the first lever handle from the extended position to the retracted position, wherein the first connector body includes a first tab and a second tab each projecting parallel to the mating axis from opposite sides of the first connector body and configured to flex the flexible beams as the first and second cam levers are moved from the staged position to a mated position, thereby disengaging the locking projections from the slots.

11. The method according to claim 10, wherein each leg of the first lever handle includes a strap spanning each slot and wherein the first and second tabs are disposed intermediate the straps and the flexible beams when the first and second cam levers are in the mated position.

12. The method according to claim 10, wherein the connector system further has a third and fourth cam stud, each projecting from opposing sides of the first connector body, a third and fourth cam lever, each attached to opposite sides of the second connector body and rotatable about a second rotation axis that is orthogonal to the mating axis, wherein the third and fourth cam levers each have a cam track configured to slidingly engage the third and fourth cam studs respectively, and a generally U-shaped second lever handle having legs slideably attached to both the third and fourth cam levers and a cross bar interconnecting the legs, wherein each leg of the second lever handle defines a slot, wherein the third and fourth cam lever each include a flexible beam having a locking projection, wherein the second lever handle is secured in the extended position when the locking projection is engaged within the slot and wherein the second lever handle is slideable to the retracted position when the locking projection is disengaged from the slot, said method further comprising the steps of:

grasping the second lever handle while the locking projections are engaged within the slots and the second lever handle is in the extended position;

pushing the second lever handle, thereby rotating the third and fourth cam levers from the staged position to the mated position;

disengaging the locking projections from the slots by flexing the flexible beams; and moving the second lever handle from the extended position to the retracted position, wherein the first and second cam levers rotate clockwise and the third and fourth cam levers rotate counterclockwise from the staged position to the mated position to move the second connector body linearly along the mating axis toward the first connector body.

13. The method according to claim 10, wherein the first connector body includes a third and fourth tab, each projecting parallel to the mating axis from opposing sides of the first connector body and configured to flex the flexible beams as the third and fourth cam levers are moved from the staged position to the mated position, thereby disengaging the locking projections from the slots.

14. The method according to claim 13, wherein each leg of the second lever handle includes a strap spanning each slot and wherein the third and fourth tabs are disposed intermediate the straps and the flexible beams when the third and fourth cam levers are in the mated position.

15. A connector system, comprising:

a first connector body in which a first terminal is disposed;

a second connector body in which a second terminal configure to mate with the first terminal is disposed, said second connector body constructed and arranged to mate with the first connector body along a mating axis;

a first and second cam stud, each projecting from opposing sides of the first connector body;

a first and second cam lever, each attached to opposite sides of the second connector body and rotatable about a first rotation axis that is orthogonal to the mating axis, wherein the first and second cam levers each have a cam track configured to slidingly engage the first and second cam studs respectively;

a generally U-shaped first lever handle having legs rotatably attached to both the first and second cam levers and a cross bar interconnecting the legs, wherein the first lever handle is moveable from an extended position to a retracted position.

16. The connector system according to claim 15, further comprising:

a third and fourth cam stud, each projecting from opposing sides of the first connector body;

a third and fourth cam lever, each attached to opposite sides of the second connector body and rotatable about a second rotation axis that is orthogonal to the mating axis, wherein the third and fourth cam levers each have a cam track configured to slidingly engage the third and fourth cam studs respectively;

a generally U-shaped second lever handle having legs rotatably attached to both the third and fourth cam levers and a cross bar interconnecting the legs, wherein the second lever handle is moveable from the extended position to the retracted position and wherein the first and second cam levers rotate clockwise and the third and fourth cam levers rotate counterclockwise from an staged position to a mated position to move the second connector body linearly along the mating axis toward the first connector body.

* * * * *